United States Patent [19]

Spuhl

[11] 4,269,300

[45] May 26, 1981

[54] METHOD AND APPARATUS FOR SEPARATING HELICAL SPRINGS CLOSED BY KNOTS AT THEIR WINDING ENDS

[75] Inventor: Walter Spuhl, St. Gallen, Switzerland

[73] Assignee: Spuhl AG, St. Gallen, Switzerland

[21] Appl. No.: 60,400

[22] Filed: Jul. 24, 1979

[30] Foreign Application Priority Data

Aug. 18, 1978 [DE] Fed. Rep. of Germany ..... 2836138

[51] Int. Cl.[3] ..... B65G 47/14

[52] U.S. Cl. ..... 198/379; 198/394; 198/491; 198/953; 414/757

[58] Field of Search ..... 198/379, 394, 486, 491, 198/953; 414/330, 757, 783; 140/3 CA; 221/210, 236

[56] References Cited

U.S. PATENT DOCUMENTS

| | | | |
|---|---|---|---|
| 3,193,136 | 7/1965 | Stumpf et al. | 198/394 X |
| 3,289,858 | 12/1966 | Naumann | 198/394 X |
| 3,441,064 | 4/1969 | Fischer et al. | 221/210 X |
| 3,588,993 | 6/1971 | Turner | 414/330 X |
| 3,990,587 | 11/1976 | Redman | 198/379 X |
| 4,050,610 | 9/1977 | Sturm | 198/486 X |
| 4,120,392 | 10/1978 | Sturm | 198/486 X |

*Primary Examiner*—James L. Rowland
*Attorney, Agent, or Firm*—Haseltine and Lake

[57] ABSTRACT

A method and apparatus for separating helical springs with knots at their coil ends, for mattress spring frames, in which the springs are moved upright and entangled in sliding guides by a conveyor belt against a stop. The lower coil end of the springs touching the stop is grasped by a gripping member. The stop is moved to an inactive position and the gripping member pulls the grasped coil end from the sliding guide by an amount equivalent to spring wire thickness. Then the stop returns to its active position and the gripping member pivots the spring by 90° into a lying position where the far end of the coil is grasped by a spring turning member. The gripping member releases the spring and returns to the starting position. Then the spring turning member rotates the spring until the knot touches a stop. After release, the spring is grasped by another gripping member and passed on to the spring frame assembly machine. The gripping member has a hook beam shiftable on a holder by an actuating member which are jointly pivotal by about 90°. The stop strip is fastened to a rocking lever and can be pivoted with the latter to an inactive position. Two rollers engage the outside of the coil end and another roller engages the inside of the coil end.

5 Claims, 10 Drawing Figures

Fig. 7
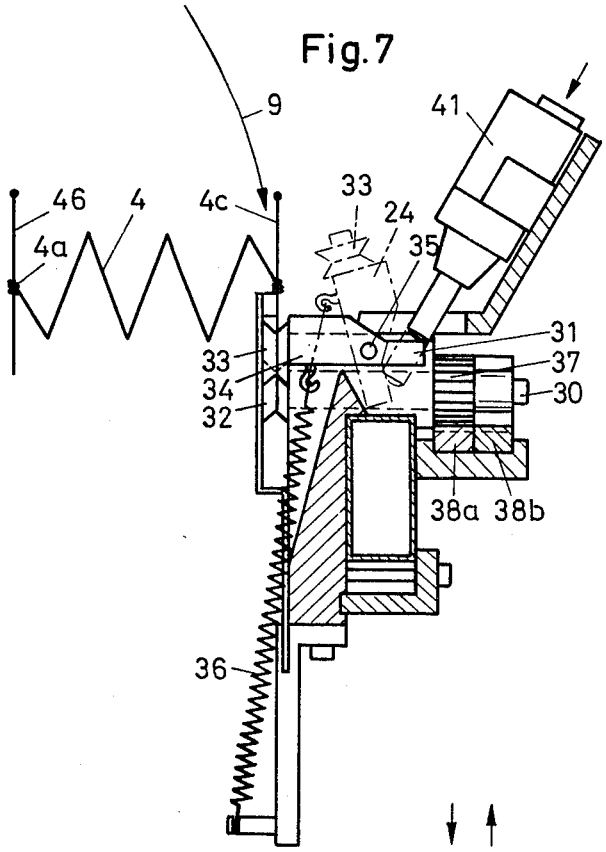
Fig. 8
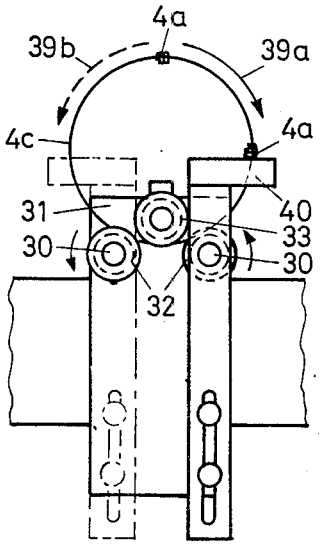
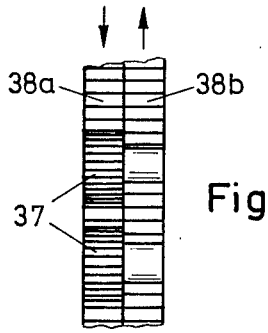
Fig. 9a
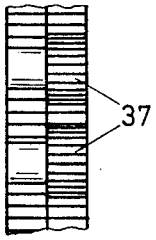
Fig. 9b

METHOD AND APPARATUS FOR SEPARATING HELICAL SPRINGS CLOSED BY KNOTS AT THEIR WINDING ENDS

BACKGROUND OF THE INVENTION

The German Pat. No. 1,552,150 discloses an arrangement for feeding helical wire springs from a spring winding machine to a spring frame assembly machine. This arrangement picks up the springs produced by the winding machine and delivers them via conveyer belts to the spring frame assembly machine which produces finished spring frames as used in mattresses and cushions. The direct connection of a winding machine with an assembly machine, however, has the disadvantage that stoppages caused, for example, by poor wire bring the entire installation to a standstill.

Therefore, it is advantageous to place the finished and already inspected springs in bunches into a feeding arrangement and to feed the spring frame assembly machine. Such an arrangement has become known from the German Laid-Open Document No. 1,752,815. Here the springs are moved by sawtoothed feed rails in a guide at whose end they are taken over by fingers. Since the knots at the winding ends of the springs during insertion into the assembly machine must be in a specific position, the springs are aligned while being fed. This known arrangement has a very complex construction which is subject to frequent breakdown.

Accordingly, it is an object of the present invention to provide a method and an arrangement to separate and align the delivered springs in a very simple manner rarely subject to trouble, and to deliver them to the known assembly machine.

Another object of the present invention is to provide an arrangement of the foregoing character which is substantially simple in construction and may be economically fabricated.

A further object of the present invention is to provide a method and device for separating helical springs, as described, which may be readily maintained in service and which has a substantially long operating life.

SUMMARY OF THE INVENTION

The objects of the present invention are achieved by grasping the lower coil end of the spring in contact with the stop with a gripping member. The stop is moved to an inactive position. The gripping member pulls the grasped coil end from the sliding guide by the amount of spring wire thickness. The stop returns to the active position. The gripping member pivots the spring by approximately 90° into a prone position where the winding end away from the gripping member is grasped by a spring turning member. The gripping member releases the spring and returns to the starting position. The spring turning member turns the spring about its lengthwise axis until the knot contacts a stop. After release by the spring turning member, the spring is grasped by another gripping member and moved forward.

The apparatus for carrying out the method has a gripping member for grasping the coil end in contact with the stop. This member has a lever connected to the driveshaft and a hook carrier shiftable to a holder by an actuating device. All these can be pivoted by 90°. The stop is mounted on a rocking lever and is pivotal to an inactive position. The spring turning device has two rollers supporting the outside of a coil end of the spring, and a third roller pivotal to an engaging and a disengaging position. This roller engages the inside of the coil end, with at least one of the rollers being driven.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 7 shows a side view of the spring turning member;

FIG. 8 shows a front view of the spring turning member without the pneumatic actuating cylinder; and FIGS. 9*a*, 9*b* show a top view of the gear rack for driving the rollers of the spring turning member for right- and left-hand rotation.

DESCRIPTION OF THE PREFERRED EMBODIMENTS

Figure 1:
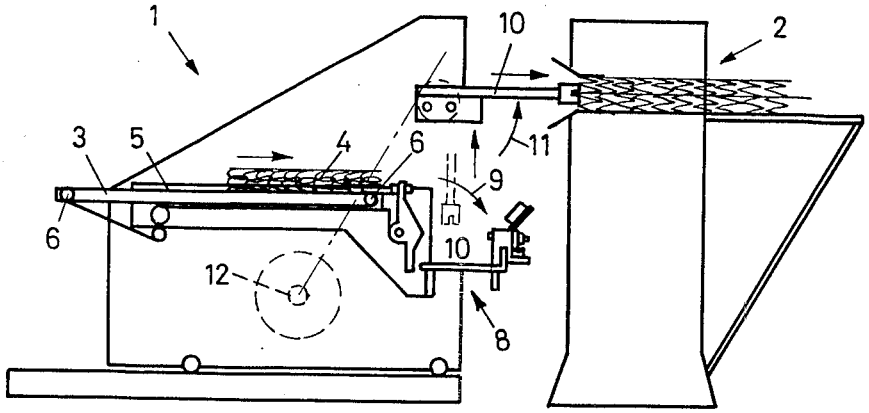
FIG. 1 shows a schematic side view of the delivery device for separating the helical springs and the spring frame assembly machine cooperating with it.
Figure 2:
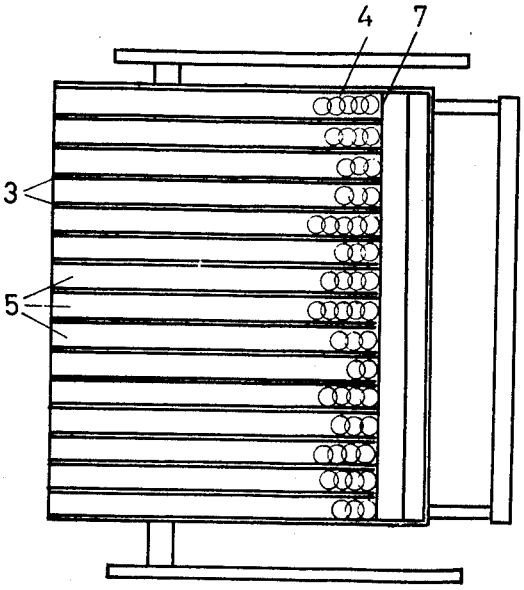
FIG. 2 shows a top view of the delivery device of FIG. 1, with the spring frame assembly machine omitted.

In FIG. 1, reference numeral 1 denotes the delivery device and reference numeral 2 denotes the spring frame assembly machine (known in the art). The delivery device has a series of parallel sliding guides 3 for springs 4 which are placed, for example, by hand in bunches upright and tangled with each other into the guides 3. The springs are shaped in a known manner. Their coil ends are tied by a knot 4*a* with the next-to-the-last coil (see FIGS. 3 and 4). Between the guides 3, driven conveyer belts 5 driven in a conventional manner are arranged. These belts revolve about deflection rollers 6 and move the spring bundles towards a stop 7 (FIG. 2). Reference numeral 8 denotes the separation mechanism according to the invention. It is shown in large scale in FIGS. 3–8. This mechanism grasps the most forward spring 4 next to the stop strip 7, turns it according to arrow 9 by 90° and aligns it by rotating it about its lengthwise axis. Then the spring is grasped by a gripping member 10, lifted, pivoted according to arrow 11 into the upright position and introduced into the assembly machine 2. The gripping member 10 is of known construction and is not part of the invention. All movements for the separation and alignment of the springs are produced by an eccentric shaft 12 via cam disks and levers or gear racks.

Figure 6:
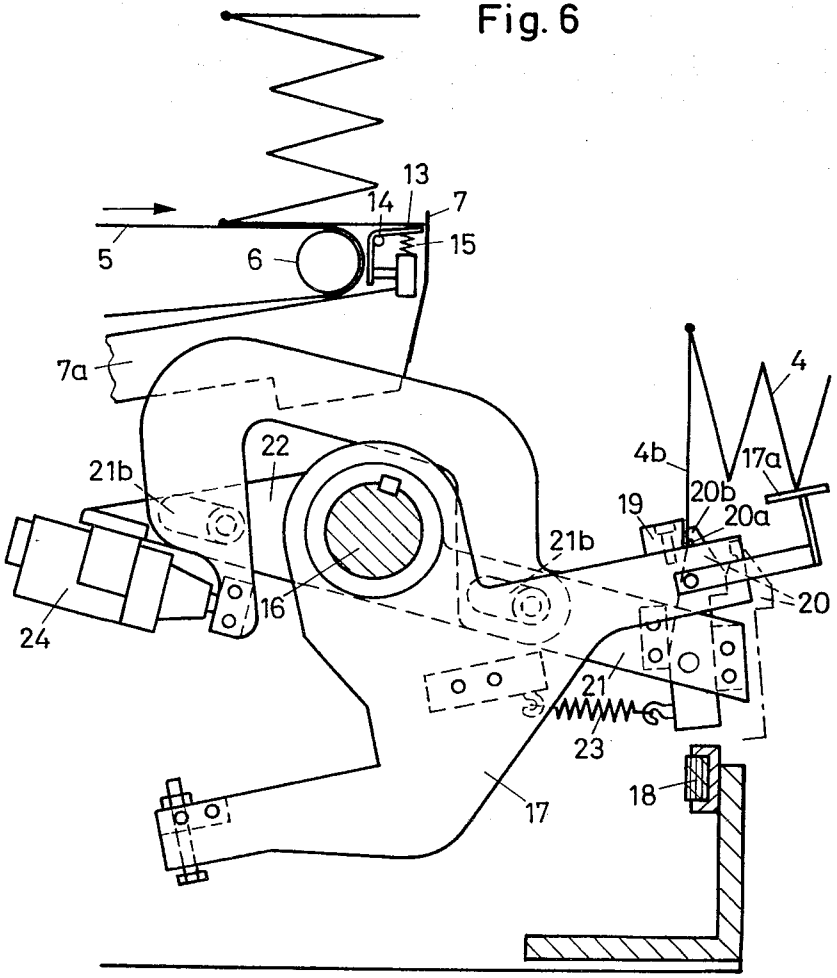
Figure 5:
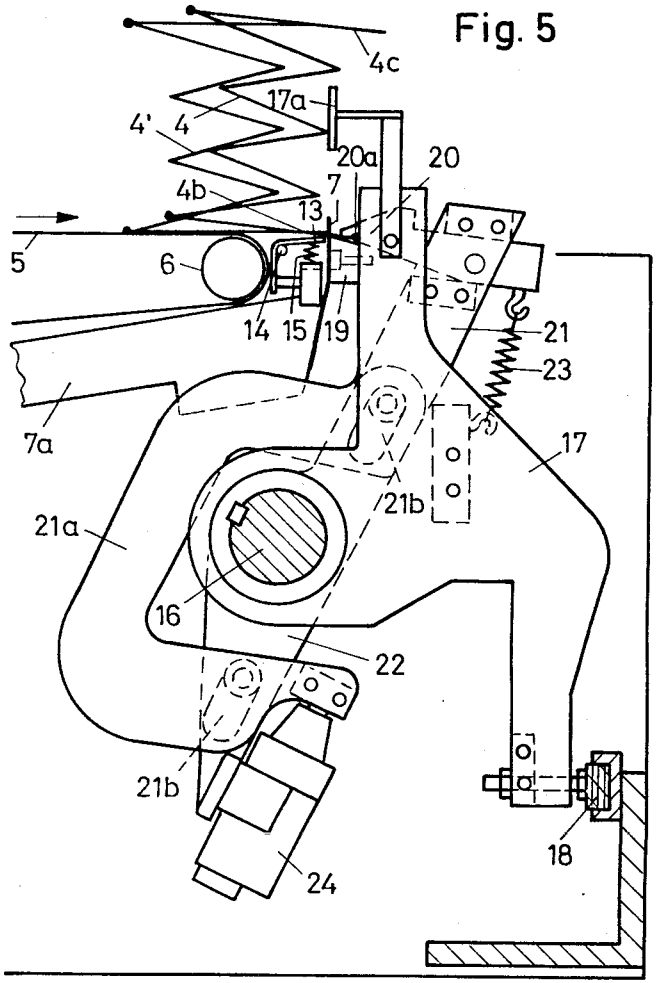

FIGS. 3–6 show the end of one of the conveyer belts 5 with the deflecting roller 6. The stop strip 7 for the lower coil end 4*b* of spring 4 is fastened to the forward end of a lever 7*a*. Between the stop strip 7 and the deflecting roller 6 is a supporting plate 13 which can yield against the pressure of a spring 15 about an axis 14 and move downward (FIG. 6).

On a shaft 16 performing pivotal movements in a certain cycle, a lever 17 is arranged. In its base position (FIGS. 3, 4, 5) it is in contact with a stop 18. On its upper end, lever 17 has a projection 19 which cooperates with a hook 20. The hook 20 is located on a beam 21 which has a C-shaped bottom portion 21*a*. The beam 21 is fastened via lengthwise slots 21*b* to a holder 22 and shiftable in relation to the latter in the direction of lengthwise slots 21*b*. A spring 23 is provided to draw the beam 21 with the hook 20 into the extended position shown in FIG. 3. A pneumatic actuating cylinder 24 can raise the beam 21 with the hook 20 to the dashed line.

FIGS. 7 and 8 show the spring turning device. It comes into operation when the spring 4 was lowered according to arrow 9 to its horizontal position. The coil end 4*c* engages the peripheral grooves of two rollers 32 whose axes 30 are rotatably held in a bearing block 31. A holder 34, pivotal about an axis 35, mounts a third roller 33. A spring 36 pulls the holder 34 continuously downward so that the roller 33, as shown in FIG. 8, rests against the inside of the coil end 4*c*, thus clamping spring 4. The holder 34 may be raised by a pneumatic cylinder 41 against the force of the spring 36 to the inactive position shown by dashed lines in FIG. 7.

The axes 30 of rollers 32 also mount gears 37 which engage a gear rack 38*a* (see FIG. 9*a*). If the gear rack 38*a* is moved in the direction of the arrow, the rollers 32 rotate the spring 4 according to arrow 39*a* in FIG. 8 until the knot 4*a* touches stop 40. According to FIGS. 7 and 9*a*, 9*b* two gear racks 38*a*, 38*b* are provided to be driven in opposite directions. By rearranging the gears 37 to the position of FIG. 9*b*, the spring may be turned for alignment in the direction of arrow 39*b*. In that case, stop 40 must also be moved.

The mode of operation of the arrangement is as follows. The conveyer belts 5 run continuously and move the springs 4 placed there to the right-hand side in FIGS. 3–6 until the most forward spring touches the stop strip 7 with its lower coil end. The conveyor belt than slides underneath springs 4 and conveys only newly deposited springs so that there is always a stacked supply of springs. By venting the cylinder 24, the hook 20 is lowered so that its notch 20*a* engages coil end 4*b* which is located at stop strip 7 which has a recess in its center.

Figure 4:
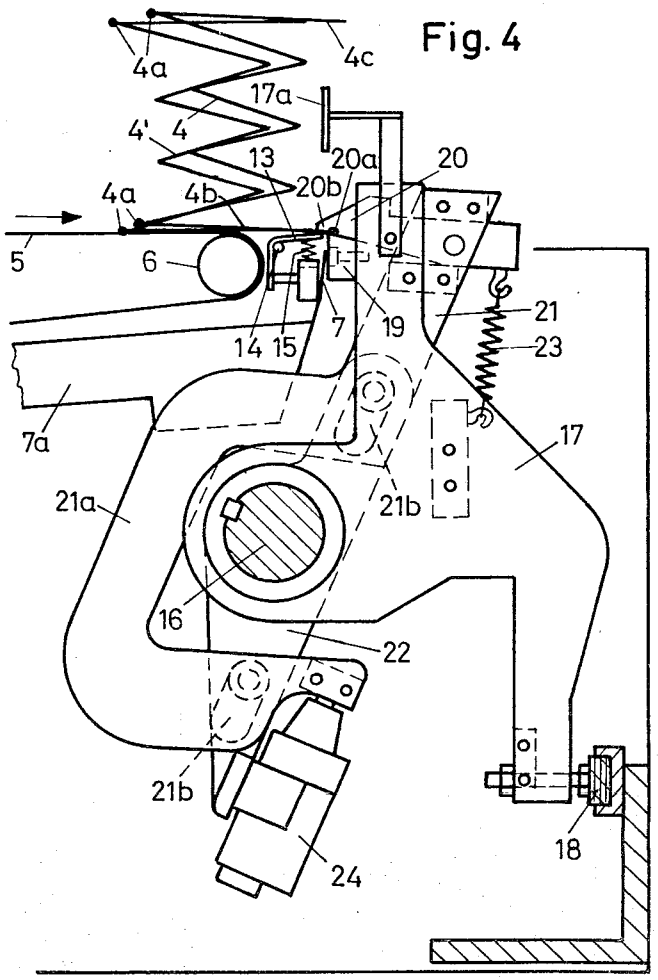
FIGS. 3–6 show the separating mechanism according to the present invention on a larger scale in various operational phases.

Then the lever 7*a* with the stop strip 7 is lowered into an inactive position and the hook 20 is pivoted to the right by a small turn of shaft 16 by slightly more than one thickness of spring wire (FIG. 4). The coil end 4*b* is clamped in hook 20 by the upper surface of projection 19. If the lower coil end of the second-most forward spring 4' is under the nose 20*b* of hook 20, the support plate 13 would be pivoted slightly downward and the coil end of spring 4' would be stripped off at projection 19.

Figure 3:
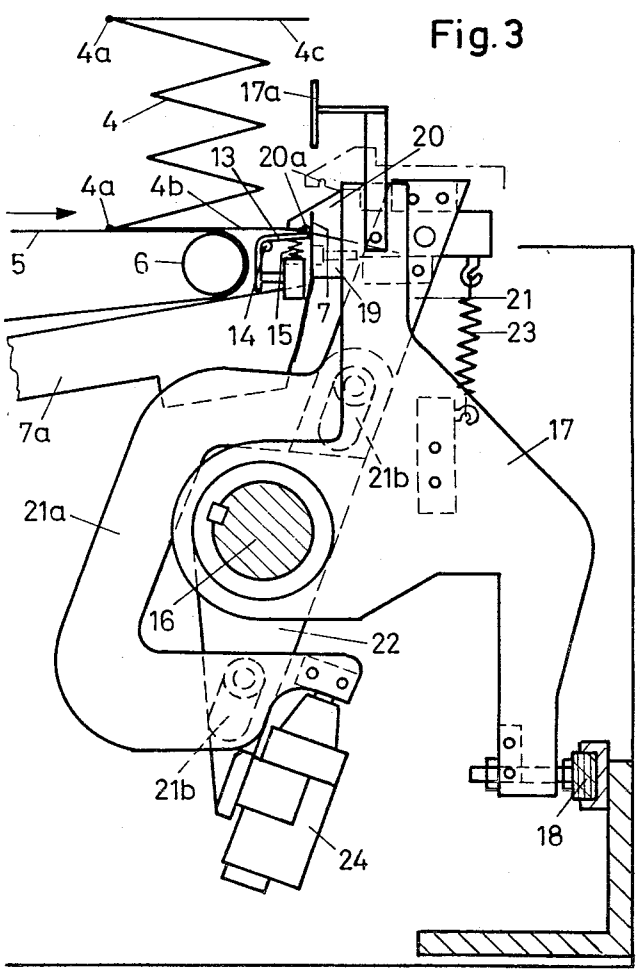

Now stop strip 7 returns upward in front of the coil end of spring 4' (see FIG. 3). The hook 20 is now pivoted with its beam 21, holder 22 and lever 17 through the shaft 16 to the position shown in FIG. 6. The spring 4 is supported at its middle turns by a strip 17*a*. The free coil end 4*c* of the spring 4 which is now horizontal is placed into the peripheral grooves of the two rollers 32 (FIG. 7). The cylinder 41 is now vented. As a result, the third roller 33 pivots downwards and positions itself between rollers 32 against the inside of coil end 4*c*. The spring 4 is now clamped in the three rollers 32, 33. Now compressed air is applied to the pneumatic cylinder 24 and the hook 20 releases the coil end 4*b* of spring 4. Then the lever 17, the beam 21 and the holder 22 jointly return to the starting position shown in FIG. 3.

The rollers 32 are driven by moving the gear racks 38*a* and 38*b*, respectively. Depending on the position of the gears 37 (FIGS. 9*a* or 9*b*) the spring is rotated in the direction of arrows 39*a* or 39*b* (FIG. 8), until the knot 4*a* touches stop 40. In this position the spring is aligned in a predetermined position. Now the spring is grasped by the gripping member 10 is a known manner and placed into the assembly machine 2 after roller 33 has been lifted (FIG. 1).

Each of the conveyer belts 5 has a separating apparatus of the above-described type so that during each working stroke, a whole series of springs is separated, aligned and inserted into the assembly machine.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A method for separating helical springs for spring frames with knots at the coil ends, said springs being moved in sliding guides by a conveyor belt against a stop while upright and entangled, the method comprising the steps of: grasping the lower coil end of a spring in contact with a stop by a gripping member; moving the stop to an inactive position; pulling the grasped coil end from the sliding guide with the gripping member by an amount substantially equal to the spring wire thickness; returning the stop to an active position; pivoting the spring by substantially 90° into a lying position by the gripping member; grasping a coil end remote from the gripping member by a spring turning member; releasing the spring from the gripping member and returning to the starting position; rotating the spring about its lengthwise axis by the spring turning member until the knot touches a stop; releasing the spring from the spring turning member; grasping the spring by a second gripping member and transporting the spring further.

2. A device for separating helical springs for spring frames with knots at the coil ends comprising: sliding guides carrying said springs; stop means; conveyor means for delivering entangled springs in said sliding guides to said stop means; a gripping member for grasping coil ends contacting said stop means; actuating means and a holder, said gripping member being shiftable on said holder through said actuating means; said actuating means pivoting jointly with said gripping member and said holder by substantially 90°; a rocking lever fastened to said stop means for pivoting into an inactive position; said coil ends having outside and inside surfaces; spring turning means having two rollers for engaging the outside of a coil end; an auxiliary roller pivotal into and out of engagement with the inside of the coil end and means for driving at least one of said rollers.

3. A device as defined in claim 2 including a support plate for a lower coil end of a spring located most forward, said support plate being ahead of said stop means and being pivotal downward about an axis against spring pressure.

4. A device as defined in claim 2 including gears and at least one gear rack for driving said rollers.

5. A device as defined in claim 4 including two gear racks running in opposite directions, said gears being rearrangeable to engage either one of said gear racks.

* * * * *